US009586773B2

(12) United States Patent
Murashima

(10) Patent No.: US 9,586,773 B2
(45) Date of Patent: Mar. 7, 2017

(54) SHEET STORAGE CASSETTE, AND IMAGE FORMING APPARATUS HAVING THE SAME

(71) Applicant: KYOCERA Document Solutions Inc., Osaka (JP)

(72) Inventor: Masaki Murashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/835,576

(22) Filed: Aug. 25, 2015

(65) Prior Publication Data

US 2016/0062294 A1 Mar. 3, 2016

(30) Foreign Application Priority Data

Aug. 28, 2014 (JP) ..... 2014-173747

(51) Int. Cl.

*B65H 1/04* (2006.01)
*B65H 1/26* (2006.01)
*G03G 15/00* (2006.01)

(52) U.S. Cl.

CPC ..... *B65H 1/266* (2013.01); *B65H 1/04* (2013.01); *G03G 15/6502* (2013.01); *B65H 2402/10* (2013.01); *B65H 2405/115* (2013.01); *B65H 2405/1122* (2013.01); *B65H 2405/11164* (2013.01); *B65H 2601/324* (2013.01)

(58) Field of Classification Search

CPC B65H 1/04; B65H 1/266; B65H 2405/11164; B65H 2405/1122; B65H 2405/115; B65H 2405/32; B65H 2402/10; B65H 2402/31; B65H 2402/441; B65H 2402/631; B65H 2402/632; B65H 2511/182; G03G 15/6502

See application file for complete search history.

(56) References Cited

U.S. PATENT DOCUMENTS 7,277,199 B2 * 10/2007 Swayze ..... B41J 13/103 271/145
7,413,362 B2 * 8/2008 Bandou ..... B65H 1/04 16/254

(Continued)

FOREIGN PATENT DOCUMENTS

JP H 5-229676 A 9/1993
JP H 5-319588 A 12/1993
JP 2006-151561 A 6/2006

*Primary Examiner* — Ernesto Suarez
(74) *Attorney, Agent, or Firm* — Stein IP, LLC

(57) ABSTRACT

A sheet storage cassette includes a cassette base and a cover member. The cover member is supported swingably at both ends of a side surface portion of the cassette base on a first rotation fulcrum, which is composed of a first engagement hole and a first boss portion, and on a second rotation fulcrum which is composed of a second engagement hole and a second boss portion. A distance from a tip end portion of the second boss portion to an engagement position of the second engagement hole is smaller than a distance from a tip end portion of the first boss portion to an engagement position of the first engagement hole, and a swing limiting portion, which limits an open angle of the cover member at the opening position, is disposed on only a portion of the cassette base near the first rotation fulcrum.

4 Claims, 9 Drawing Sheets

(56) References Cited

U.S. PATENT DOCUMENTS

| | | | | |
|---|---|---|---|---|
| 7,484,727 | B2 * | 2/2009 | Yang | B65H 1/266<br>271/171 |
| 7,520,502 | B2 * | 4/2009 | Maeda | B41J 29/13<br>271/145 |
| 7,810,806 | B2 * | 10/2010 | Takasaka | B65H 3/0623<br>271/109 |
| 9,015,903 | B2 * | 4/2015 | Oraa Gil | H05K 5/0239<br>16/223 |
| 2004/0253032 | A1 * | 12/2004 | Kojima | B41J 13/103<br>400/101 |

* cited by examiner

SHEET STORAGE CASSETTE, AND IMAGE FORMING APPARATUS HAVING THE SAME

INCORPORATION BY REFERENCE

The present application is based on Japanese Patent Application No. 2014-173747 filed on Aug. 28, 2014, the contents of which are hereby incorporated by reference.

BACKGROUND

The present disclosure relates to a sheet storage cassette that stores sheet-like recording mediums such as paper sheets and the like used in a copy machine, a printer, a facsimile, a multi-function machine of them and the like and to an image forming apparatus that includes the sheet storage cassette.

A sheet feeding cassette, which stores a plurality of sheets (paper sheets), is disposed in a drawable manner on a bottom portion of a main body of an image forming apparatus; a separating and feeding device composed of a pick-up roller and the like disposed above the sheet feeding cassette sends out successively the sheets stored in the sheet feeding cassette one after another, and a conveyance roller conveys the sheets to an image forming portion and a fixing portion, whereby an image is formed on the sheets.

There are sheet feeding cassettes in which a cassette base, which stores sheets in accordance with sheet sizes such as an A-system size, a B-system size, an inch-system size and the like, is composed in a stretchable and shrinkable manner. Here, because of a need for compactness of an image forming apparatus in recent years, there is a case where the area of the sheet feeding cassette becomes larger than the area of a main body of the image forming apparatus. In such a case, a portion of the sheet feeding cassette protrudes from the main body of the image forming apparatus; accordingly, there is a risk that foreign matter such as dust and the like would enter the sheet feeding cassette from the protruding portion.

Because of this, a sheet feeding cassette is known, in which an upper-surface cover is disposed on the cassette base to prevent foreign matter from entering.

In a case where the upper-surface cover is mounted swingably on the cassette base, generally, bosses (or engagement holes) formed at two pivots of the cassette base are press-fitted into two engagement holes (or bosses) formed at two pivots of the upper-surface cover. Here, considering assembly efficiency, an engagement amount of the boss and the engagement hole is made large at one rotation fulcrum, while an engagement amount of the boss and the engagement hole is made small at the other rotation fulcrum, and the engagement portion having the smaller engagement amount is bent to perform press-fitting.

SUMMARY

A sheet storage cassette according to an aspect of the present disclosure includes a cassette base and a cover member. The cassette base stores a sheet. The cover member is supported swingably on the cassette base and selectively disposed at a closing position to cover an upper surface of the cassette base and an opening position to open the upper surface of the cassette base. The cover member is supported swingably at both ends of a side surface portion of the cassette base on a first rotation fulcrum, which is composed of a first engagement hole formed in either one of the cover member and the cassette base and a first boss portion that is formed on the other one of the cover member and the cassette base and engages with the first engagement hole, and on a second rotation fulcrum which is composed of a second engagement hole formed in either one of the cover member and the cassette base and a second boss portion that is formed on the other one of the cover member and the cassette base and engages with the second engagement hole. A distance from a tip end portion of the second boss portion to an engagement position of the second engagement hole is smaller than a distance from a tip end portion of the first boss portion to an engagement position of the first engagement hole, and a swing limiting portion, which limits an open angle of the cover member at the opening position, is disposed on only a portion of the cassette base near the first rotation fulcrum.

Still other objects of the present disclosure and specific advantages obtained by the present disclosure will become more apparent from the following description of an embodiment.

DETAILED DESCRIPTION

Figure 1:
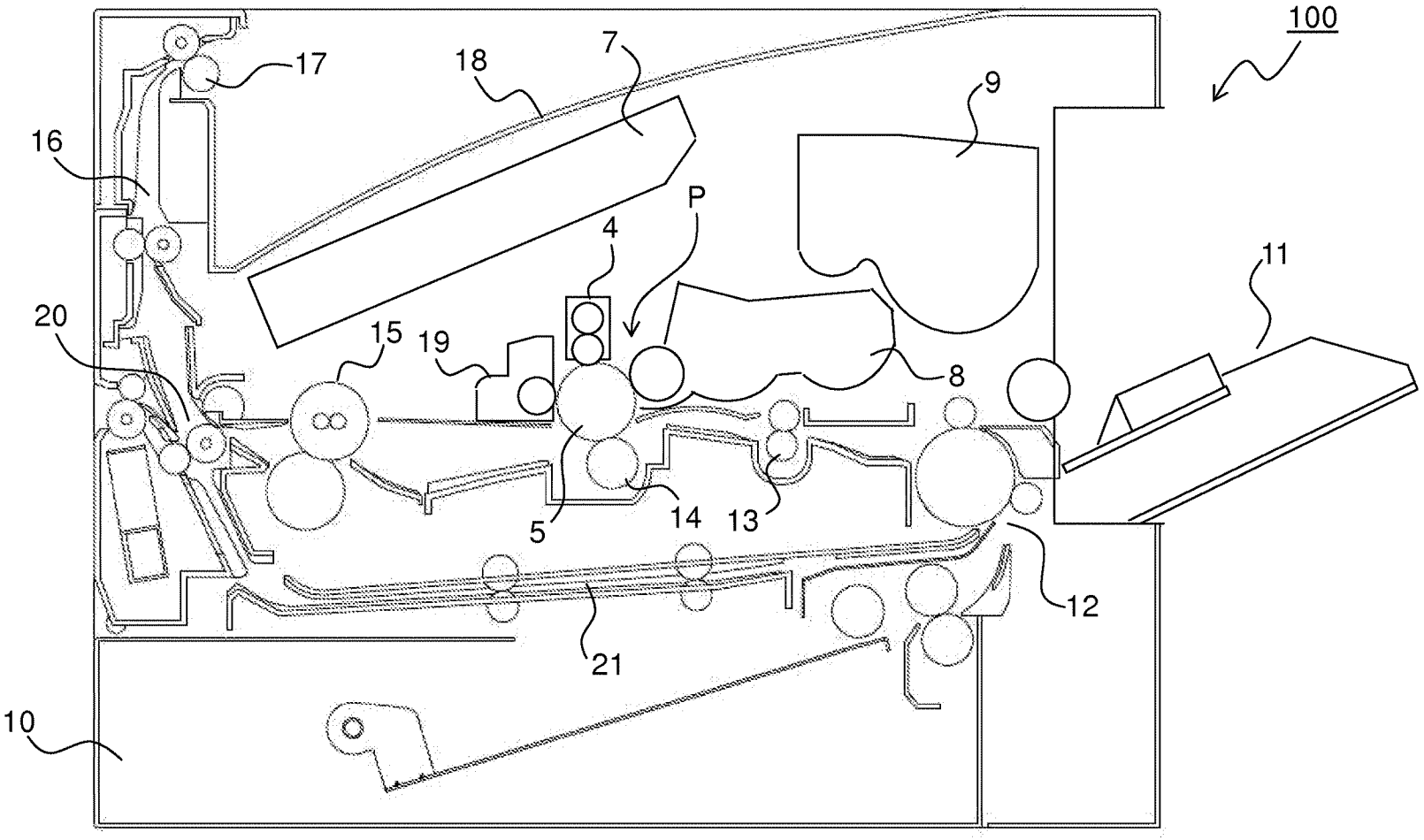
FIG. 1 a side cross-sectional view showing an internal structure of an image forming apparatus 100 which incorporates a sheet feeding cassette 10 according to an embodiment of the present disclosure.

Hereinafter, with reference to the drawings, an embodiment of the present disclosure is described. FIG. 1 is a side cross-sectional view showing an internal structure of the image forming apparatus 100 which incorporates the sheet feeding cassette 10 according to the embodiment of the present disclosure. The image forming apparatus (e.g., a monochromatic printer) 100 is provided therein with an image forming portion P that forms an image through each step of electrification, light exposure, development, and transfer. The image forming portion P is provided with a charging unit 4, a light exposure unit (laser scanning unit and the like) 7, a development unit 8, a transfer unit 14, a cleaning device 19, and an electricity removal device (not shown) along a rotation direction (clockwise direction in FIG. 1) of a photosensitive drum 5.

In a case where an image forming operation is performed, the charging unit 4 electrifies evenly the photosensitive drum 5 that rotates in the clockwise direction, a laser beam from the light exposure unit 7 based on document image data forms an electrostatic latent image onto the photosensitive drum 5, and the development unit 8 makes developer (hereinafter, called toner) adhere to the electrostatic latent image and thereby forms a toner image.

The toner supply to the development unit 8 is performed from a toner container 9. In the meantime, the image data are transmitted from a personal computer (not shown) and the like. Besides, the electricity removal device (not shown) for removing electric charges remaining on a surface of the photosensitive drum 5 is disposed in a downstream side of the cleaning device 19.

A sheet is conveyed from the sheet feeding cassette 10 or a manual sheet feeding device 11 to the photosensitive drum 5, on which the toner image is formed as described above, via a sheet conveyance path 12 and a registration roller pair 13, and the transfer roller 14 (image transfer portion) transfers the toner image formed on the surface of the photosensitive drum 5 onto the sheet. The sheet, on which the toner image is transferred, is separated from the photosensitive drum 5 and conveyed to a fixing device 15, where the toner image is fixed. The sheet passing through the fixing device 15 is conveyed to an upper portion of the apparatus by a sheet conveyance path 16, and is delivered onto a delivery tray 18 by a delivery roller pair 17 in a case where an image is formed onto one surface only of the sheet (one-side printing).

On the other hand, in a case where images are formed onto both surfaces of the sheet (both-side printing), after a rear end of the sheet passes a bent portion 20 of the sheet conveyance path 16, the conveyance direction is reversed. In this way, the sheet is directed to a reverse conveyance path 21 that branches off from the bent portion 20, and reconveyed to the registration roller pair 13 with the image surface reversed. And, the next toner image formed on the photosensitive drum 5 is transferred by the transfer roller 14 onto a surface of the sheet on which an image is not formed. The sheet on which the toner image is transferred is conveyed to the fixing device 15 and the toner image is fixed, thereafter, the sheet is delivered onto the delivery tray 18 by the delivery roller pair 17.

Figure 2:
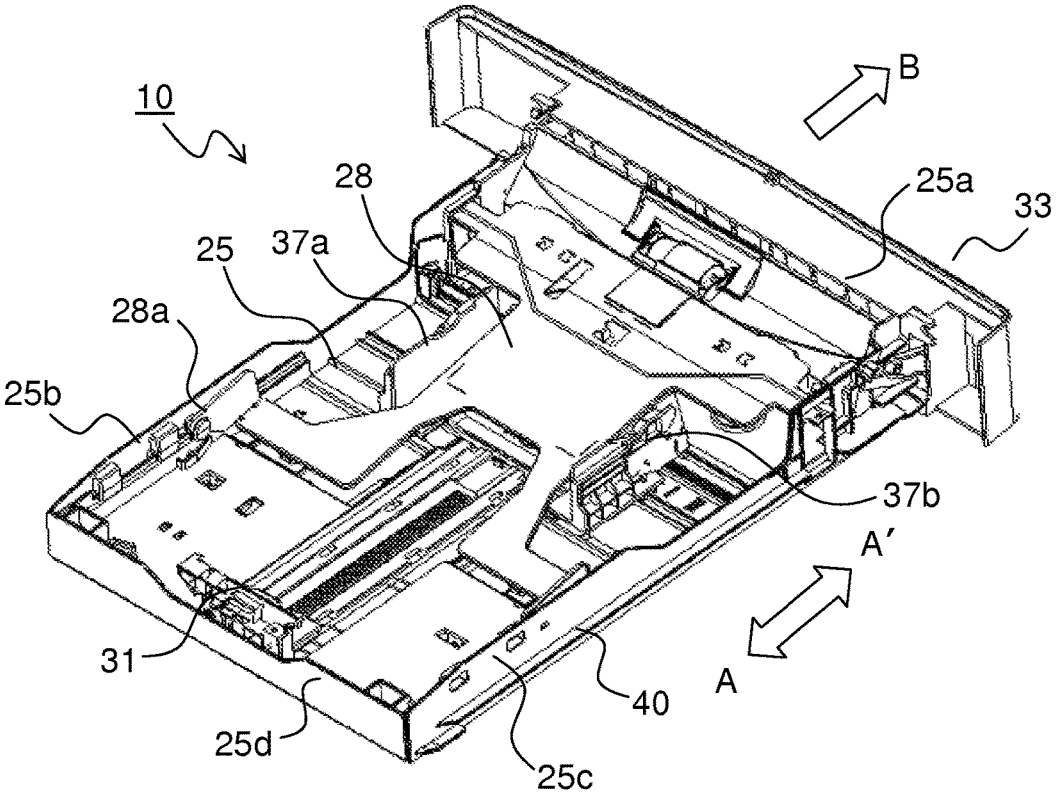
FIG. 2 is a perspective view showing a state in which the sheet storage cassette 10 is drawn out from a main body of the image forming apparatus 100.
Figure 3:
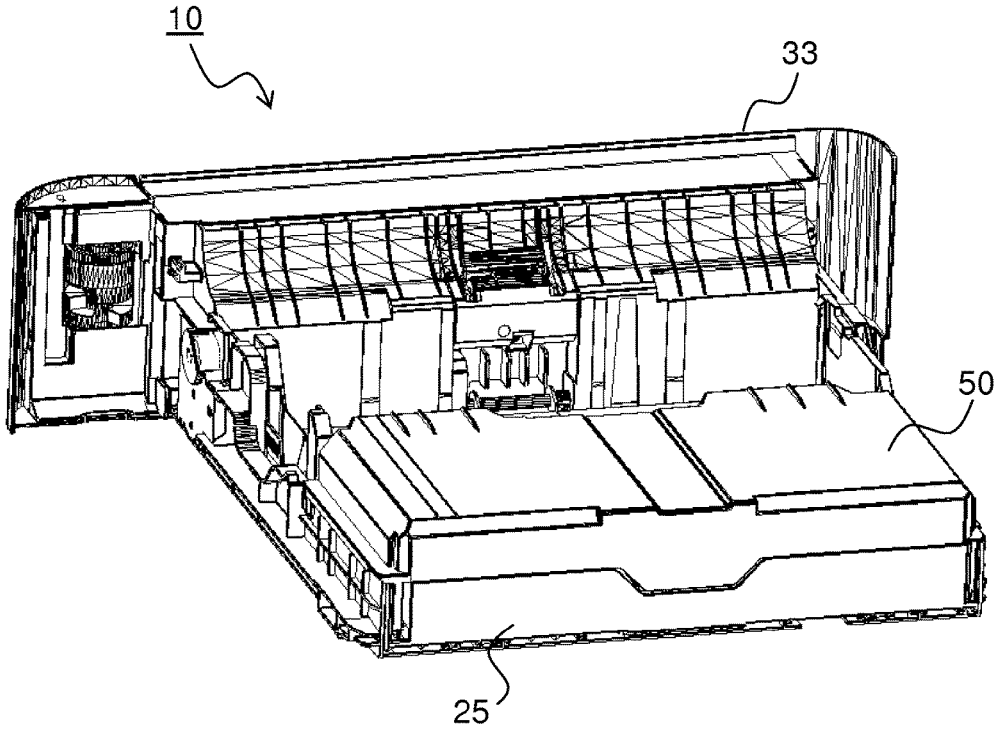
FIG. 3 is a perspective view seeing the sheet feeding cassette 10 from an upstream side in a sheet feeding direction.

Next, a structure of the sheet feeding cassette 10 is described. FIG. 2 is a perspective view showing a state in which the sheet storage cassette 10 is drawn out from a main body of the image forming apparatus 100, and FIG. 3 is a perspective view seeing the sheet feeding cassette 10 from an upstream side in a sheet feeding direction. In the meantime, FIG. 2 shows a state in which an upper-surface cover 50 is removed.

In FIG. 2, an arrow A shows a direction in which the sheet feeding cassette 10 is inserted into the main body of the image forming apparatus 100, an arrow A' shows a direction in which the sheet feeding cassette 10 is drawn out, and an arrow B shows a sheet feeding direction of the sheet feeding cassette 10. A cassette base 25 composes a housing of the sheet feeding cassette 10 and has a tray shape in which side walls 25*a*-25*d* are formed on four edges of a rectangular bottom surface. Besides, to store a large size sheet (e.g., A3 size), the cassette base 25 is stretchable and shrinkable in a direction (arrow AA' direction) parallel with the sheet feeding direction.

As shown in FIG. 3, the upper-surface cover 50 is mounted on a rear end portion of the cassette base 25 in an openable and closable manner. When the cassette base 25 is stretched, the rear end portion of the cassette base 25 protrudes from the main body of the image forming apparatus 100 (see FIG. 4); accordingly, the protruding portion of the cassette base 25 is covered by the upper-surface cover 50 to prevent foreign matter from entering the cassette base 25. In the meantime, FIG. 3 shows the state in which the upper-surface cover 50 is disposed at a closing position to cover the upper surface of the cassette base 25.

A cassette cover 33 is mounted on the side wall 25*a* in a downstream side in the inserting direction of the sheet feeding cassette 10. As to the cassette cover 33, its front side (right upper side of FIG. 2) is exposed to outside to compose a portion of an outer surface of the main body of the image forming apparatus 100 (see FIG. 1).

As to a sheet loading plate 28 on which a sheet is loaded, its end portion located in a downstream side in the sheet feeding direction (right upper portion of FIG. 2) is disposed to be able to vertically step up and down with the aid of a coil spring (not shown) with respect to the bottom surface of the cassette base 25 on left and right swing shafts 28*a* used as pivots located in an upstream side in the sheet feeding direction (left lower portion of FIG. 2). Besides, both sides of the sheet loading plate 28 in a width direction are provided with a pair of width limiting cursors 37*a*, 37*b*, which performs width-directional positioning of the sheet loaded on the sheet loading plate 28, to be able to reciprocate in the sheet width direction (direction perpendicular to the arrow B direction of the figure) along a guide groove formed on the cassette base 25.

Besides, the sheet is sent out in the arrow B direction to the sheet conveyance path 16 (see FIG. 1); accordingly, a rear end cursor 31 for aligning the rear end of the sheet is disposed to be able to reciprocate in parallel with the sheet feeding direction (arrow B direction of the figure) along the guide groove formed on the cassette base 25. By moving the width limiting cursors 37*a*, 37*b* and the rear end cursor 31 in accordance with the loaded sheet size, the sheet is stored at a predetermined position in the sheet feeding cassette 10.

Guide rails 40 are disposed on outer sides of the side walls 25*b*, 25*c* parallel with the inserting or drawing direction (arrow AA' direction) of the sheet feeding cassette 10. The main body of the image forming apparatus 100 is provided with a rail support portion (not shown) that supports slidably the guide rail 40, and by sliding the guide rail 40 along the rail support portion, the sheet feeding cassette 10 can be inserted into and drawn out from the main body of the image forming apparatus 100.

Figure 4:
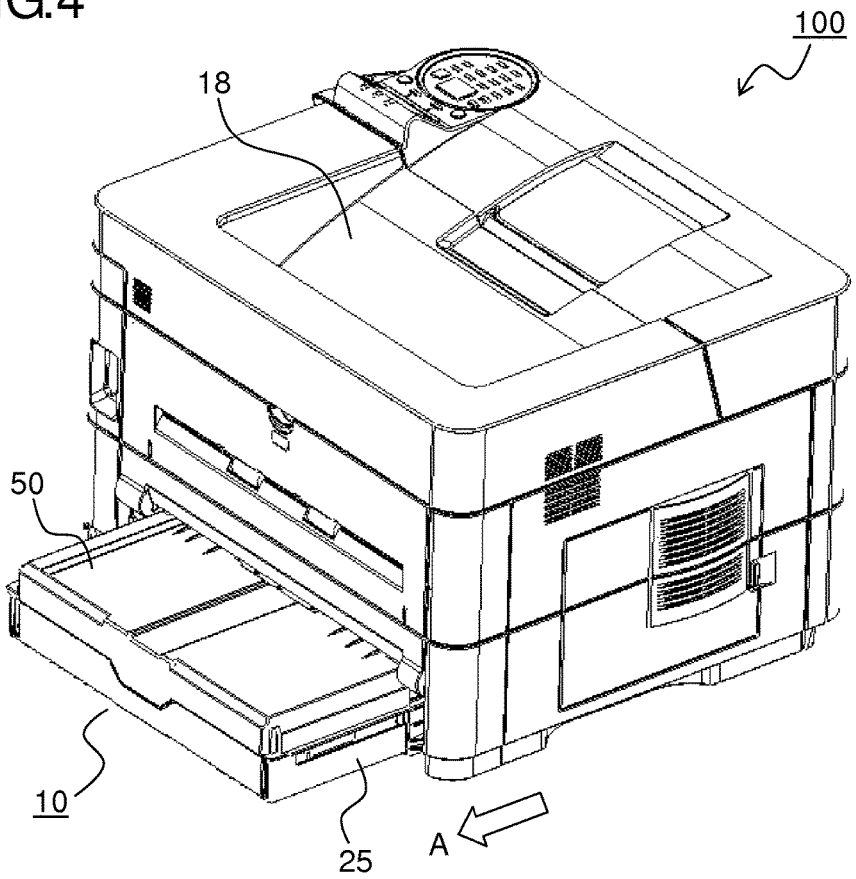
FIG. 4 is an appearance perspective view of the image forming apparatus 100 in which the sheet storage cassette 10 is mounted.

FIG. 4 is an appearance perspective view of the image forming apparatus 100 in which the sheet storage cassette 10 is mounted. In FIG. 4, a large-size (A3 size) sheet is stored in the sheet feeding cassette 10, and the cassette base 25 is stretched in the direction parallel with the sheet feeding direction. Because of this, the rear end portion of the cassette base 25 protrudes from the main body of the image forming apparatus 100, and the protruding portion of the cassette base 25 is covered by the upper-surface cover 50.

Figure 5:
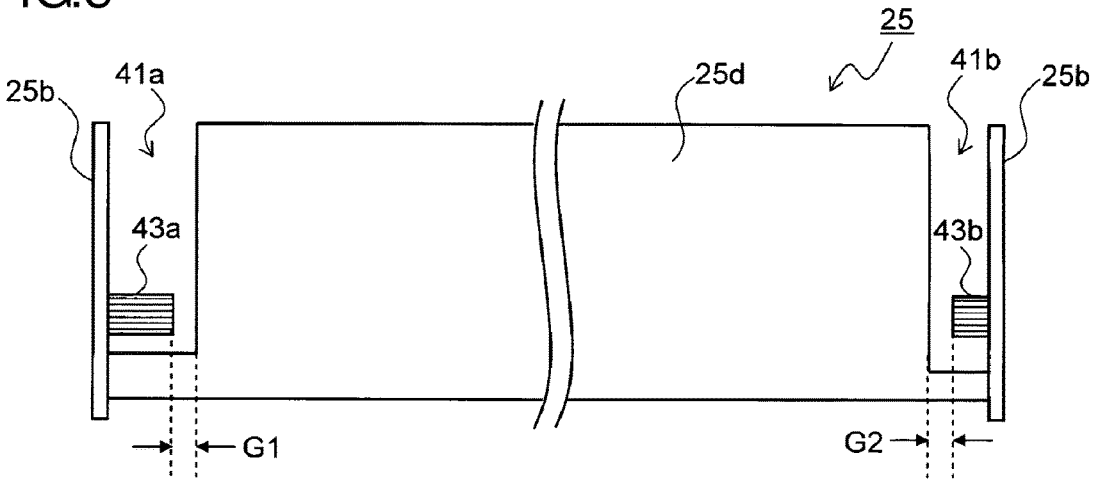
FIG. 5 is a view showing arm inserting grooves 41*a*, 41*b* formed at both ends of a cassette base 25 in an upstream side in a sheet feeding direction.
Figure 7:
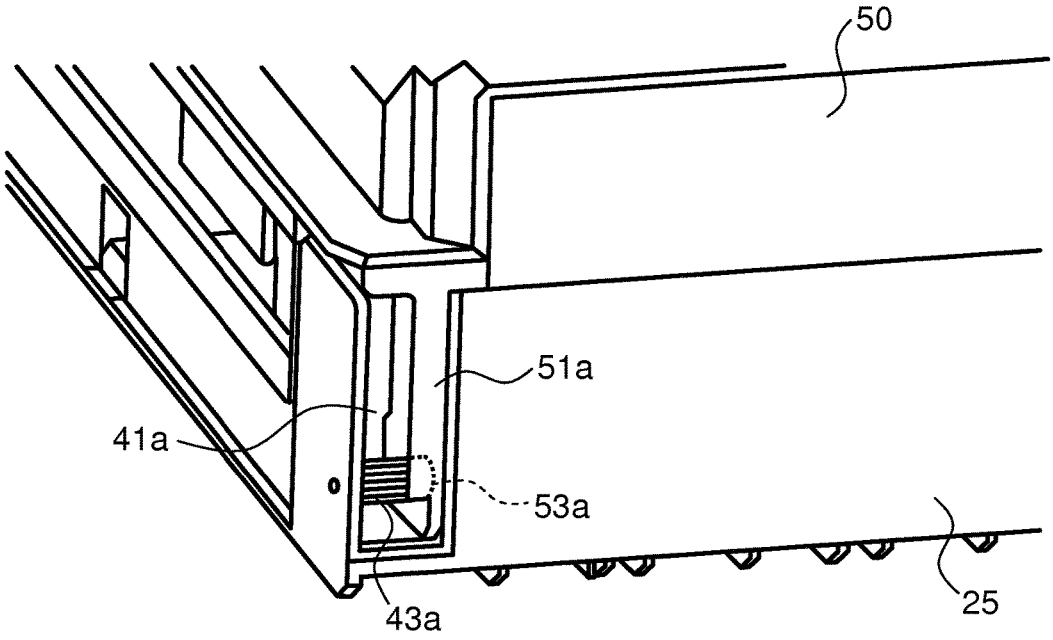
FIG. 7 is a view showing a state in which from the state of FIG. 6, a first engagement hole 53*a* formed at a tip end of the support arm 51*a* is engaged with a first boss portion 43*a*.
Figure 8:
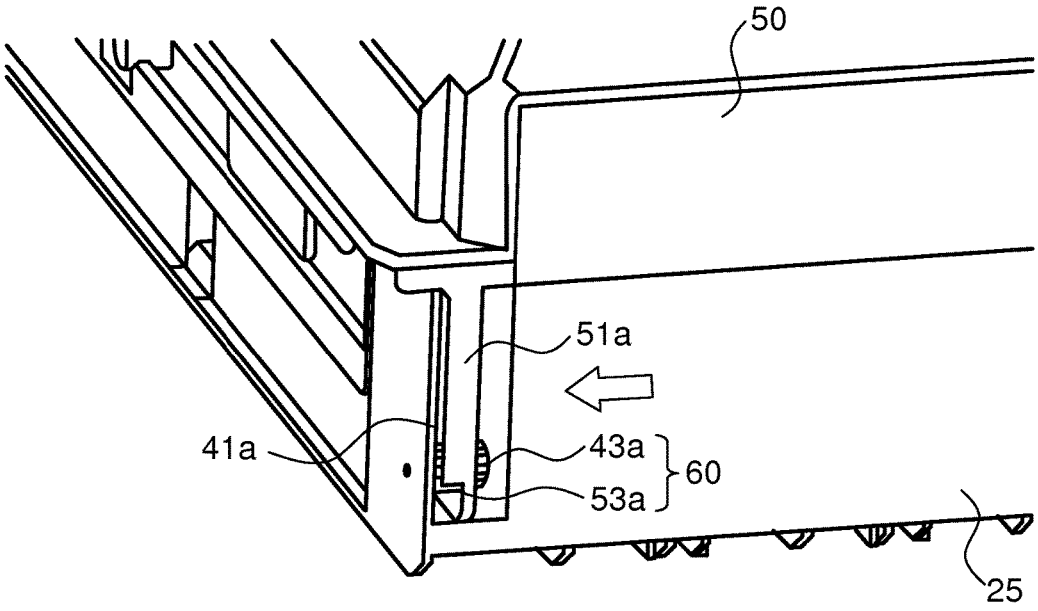
FIG. 8 is a view showing state in which from the state of FIG. 7, the upper-surface cover 50 is slid in a left direction when seeing from an upstream side in a sheet feeding direction.

Next, a method for mounting the upper-surface cover 50 onto the cassette base 25 is described. FIG. 5 is a view showing arm inserting grooves 41*a*, 41*b* formed at both ends of the cassette base 25 in the upstream side in the sheet feeding direction, FIG. 6-Fig. 8 are each a view showing a procedure of mounting the upper-surface cover 50 at one end portion (left side of FIG. 3) of the cassette base 25, FIG. 9 and FIG. 10 are each a view showing a procedure of mounting the upper-surface cover 50 at the other end portion (right side of FIG. 3) of the cassette base 25.

Figure 6:
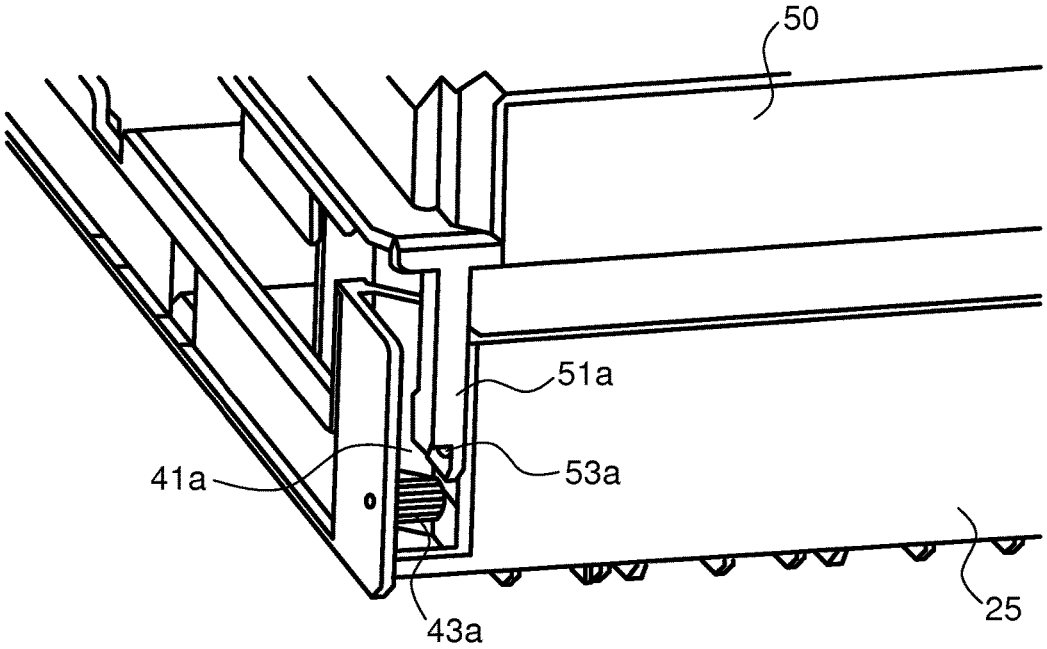
FIG. 6 is a view showing a procedure of mounting an upper-surface cover 50 at one end portion (left side of FIG. 3) of the cassette base 25, and a view showing a scene in which a support arm 51*a* of the upper-surface cover 50 is inserted into the arm inserting groove 41*a* of the cassette base 25.
Figure 9:
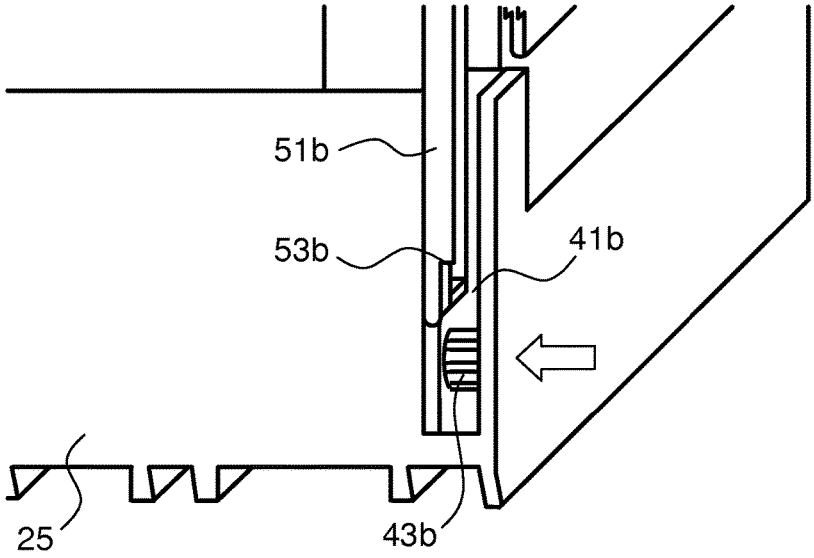
FIG. 9 is a view showing a procedure of mounting the upper-surface cover 50 at the other end portion (right side of FIG. 3) of the cassette base 25, and a view showing a scene in which a support arm 51*b* of the upper-surface cover 50 is inserted into the arm inserting groove 41*b* of the cassette base 25.
Figure 10:
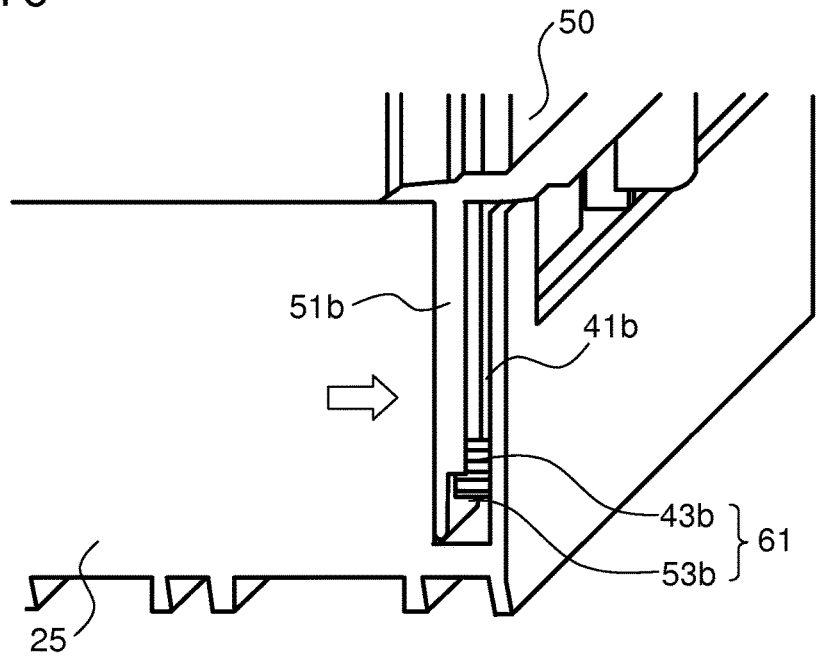
FIG. 10 is a view showing a state in which from the state of FIG. 9, a second engagement hole 53*b* formed at a tip end of the support arm 51*b* is engaged with a second boss portion 43*b*.

At swing end portions (in a downstream side in the arrow A direction of FIG. 4) of the upper-surface cover 50, support arms 51*a*, 51*b* are formed which protrude downward from both sides in the sheet width direction (see FIG. 6, FIG. 9). Tip ends of the support arms 51*a*, 51*b* are provided with engagement holes 53*a*, 53*b*.

Bedsides, as shown in FIG. 5, at two left and right corners (corner portions) of the rear end portion of the cassette base 25, the arm inserting grooves 41*a*, 41*b*, into which the support arms 51*a*, 51*b* are inserted respectively, are formed from both end portions of the side wall 25*d* to the side wall 25*b*. A first boss portion 43*a* and a second boss portion 43*b*, with which the first engagement hole 53*a* and second engagement hole 53*b* of the support arms 51*a* and 51*b* engage, protrude from end surfaces of the side wall 25*b*, which compose internal wall surfaces of the arm inserting grooves 41*a*, 41*b*, to the internal wall surfaces (end portions of the side wall 25*d*) that oppose end surfaces of the side wall 25*b*.

Predetermined gaps G1, G2 are each formed between each of the tip end portions of the first boss portions 43*a*, 43*b* and each of the internal wall surfaces (both end portions of the side wall 25*d*) of the arm inserting grooves 41*a*, 41*b* that oppose the first boss portion 43*a* and the second boss portion 43*b*. The arm inserting groove 41*a* is formed wider than the arm inserting groove 41*b* when seeing from the upstream side in the sheet feeding direction (from a point over the paper surface of FIG. 5). The first boss portion 43*a* protrudes from the side wall 25*b* by a protrusion amount larger than the second boss portion 43*b*, and the gap G1 in the arm inserting groove 41*a* and the gap G2 in the arm inserting groove 41*b* are equal to each other.

Besides, a distance between the support arms 51*a*, 51*b* of the upper-surface cover 50 is wider than a distance between the first boss portion 43*a* and the second boss portion 43*b*.

In a case of mounting the upper-surface cover 50, as shown in FIG. 6, the left support arm 51*a* of the upper-surface cover 50 when seeing from the upstream side in the sheet feeding direction is inserted into the left arm inserting groove 41*a* of the cassette base 25. The first boss portion 43*a* protrudes inward from the outside surface (left surface of FIG. 6) of the arm inserting groove 41*a*; accordingly, the support arm 51*a* is inserted into the gap G1 (see FIG. 5) between the first boss portion 43*a* and the internal wall surface on the inner side (right side of the left portion of FIG. 6) of the arm inserting groove 41*a*.

And, as shown in FIG. 7, the first engagement hole 53*a* formed at the tip end of the support arm 51*a* is made to oppose the first boss portion 43*a*. Further, as shown in FIG. 8, by sliding the upper-surface cover 50 in a left direction (arrow direction in FIG. 8) when seeing from the upstream side in the sheet feeding direction, the first boss portion 43*a* is inserted into the first engagement hole 53*a* of the support arm 51*a*. After the first engagement hole 53*a* engages with the tip end portion (right end of the left portion of FIG. 8) of the first boss portion 43*a*, the first engagement hole 53*a* moves to the proximal portion (left end of FIG. 8) because of the sliding of the upper-surface cover 50; accordingly, the first boss portion 43*a* and the first engagement hole 53*a* do not easily disengage themselves from each other.

Next, as shown in FIG. 9, the right support arm 51*b* of the upper-surface cover 50 when seeing from the upstream side in the sheet feeding direction is inserted into the right arm inserting groove 41*b* of the cassette base 25. The second boss portion 43*b* protrudes inward (arrow direction in FIG. 9) from the outside surface (right surface of FIG. 9) of the arm inserting groove 41*b*. Besides, the distance between the support arms 51*a*, 51*b* is wider than the distance between the first boss portion 43*a* and the second boss portion 43*b*; accordingly, in the state in which the upper-surface cover 50 is slid to the left side and force is not exerted on the support arm 51*b*, the support arm 51*b* protrudes to a position to overlap the second boss portion 43*b*. Because of this, with the support arm 51*b* bent inward (left direction in FIG. 9), the support arm 51*b* is inserted into the gap G2 (see FIG. 5) between the second boss portion 43*b* and the inner surface (left surface of the right portion of FIG. 9) of the arm inserting groove 41*b*.

And, as shown in FIG. 10, the second engagement hole 53*b* formed at the tip end of the support arm 51*b* is engaged with the second boss portion 43*b*. As shown in FIG. 5, the second boss portion 43*b* is shorter (the protrusion amount is smaller) than the first boss portion 43*a*; accordingly, by only bending the support arm 51*b* slightly, it is possible to engage the second engagement hole 53*b* with the second boss portion 43*b*. Thereafter, by removing the force exerted on the support arm 51*b*, the support arm 51*b* bent inward returns in the right direction (arrow direction in FIG. 10) with the aid of restoration force. In this way, the engagement position of the second engagement hole 53*b* moves from the tip end portion of the second boss portion 43*b* to the proximal portion; accordingly, the second boss portion 43*b* and the second engagement hole 53*b* do not easily disengage themselves from each other.

As described above, the upper-surface cover 50 is mounted swingably onto the rear end of the cassette base 25. The engagement portion of the first boss portion 43*a* and first engagement hole 53*a* and the engagement portion of the second boss portion 43*b* and second engagement hole 53*b* respectively serve as the first rotation fulcrum 60 and second rotation fulcrum 61 of the upper-surface cover 50 with respect to the cassette base 25. The upper-surface cover 50 swings with respect to the cassette base 25 on the first rotation fulcrum 60 and the second rotation fulcrum 61.

Figure 11:
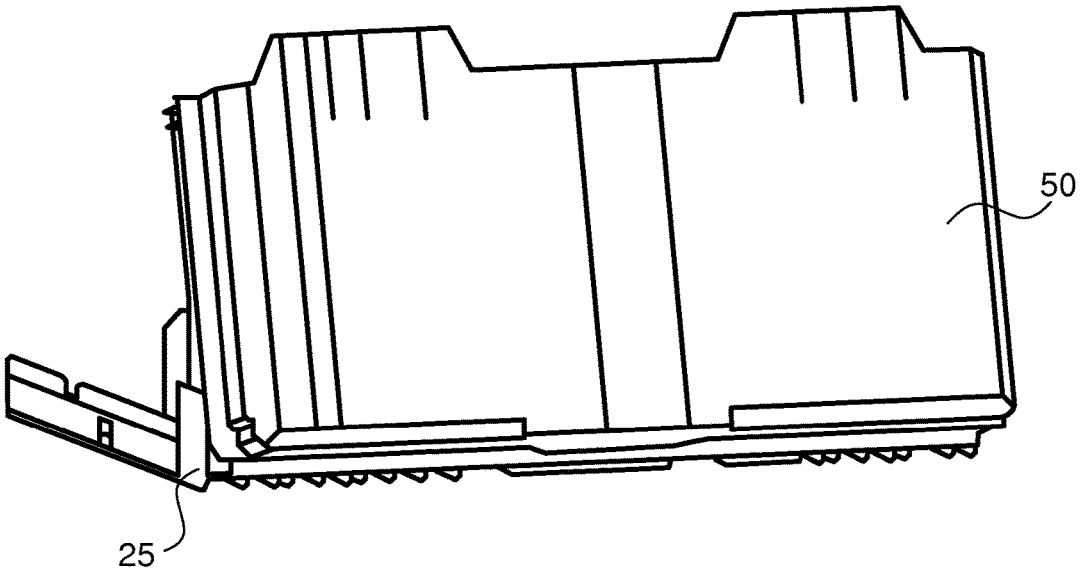
FIG. 11 is a perspective view of the sheet feeding cassette 10 showing a state in which from the state of FIG. 3, the upper-surface cover 50 is swung in an upward direction to be moved to an opening position.

FIG. 11 is a perspective view showing a state in which from the state of FIG. 3, the upper-surface cover 50 is swung in an upward direction to be moved to an opening position. As shown in FIG. 11, by swinging the upper-surface cover 50 to open the upper surface of the cassette base 25, it is possible to easily load a sheet onto the sheet loading plate 28 (see FIG. 2) in the cassette plate 25.

Figure 12:
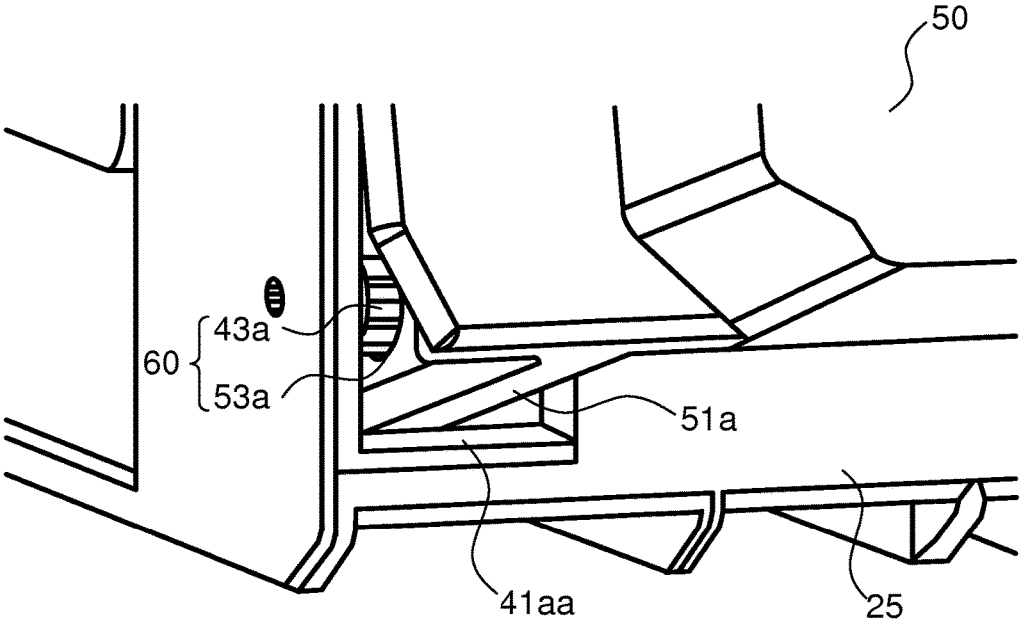
FIG. 12 is a partially enlarged view of a first rotation fulcrum 60 where the first boss portion 43*a* and the first engagement hole 53*a* engage with each other when the upper-surface cover 50 is disposed at the opening position.
Figure 13:
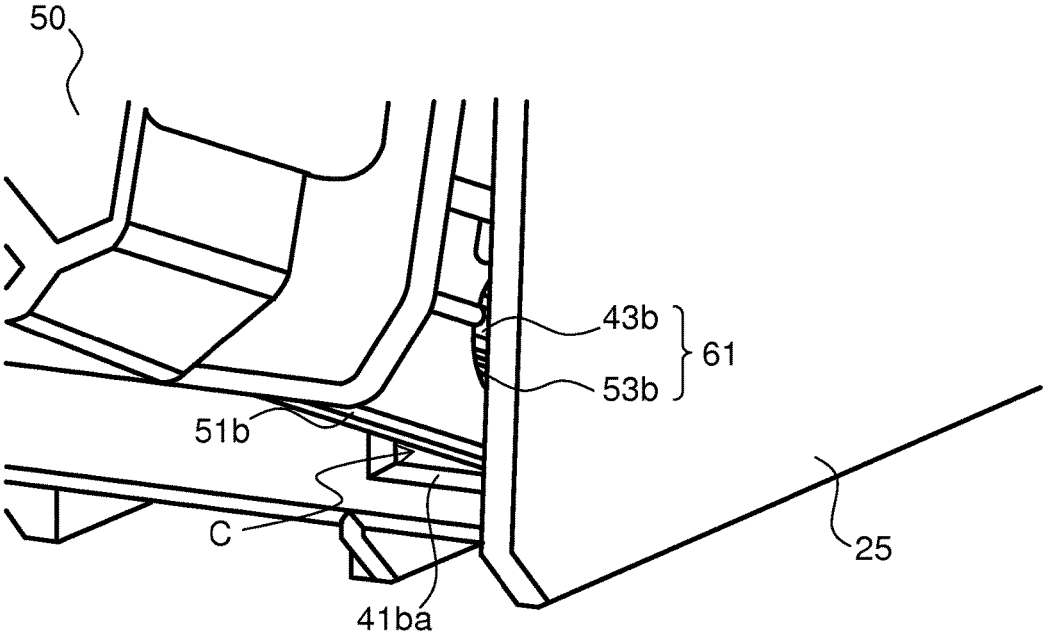
FIG. 13 is a partially enlarged view of a second rotation fulcrum 61 where the second boss portion 43*b* and the second engagement hole 53*b* engage with each other when the upper-surface cover 50 is disposed at the opening position.

FIG. 12 and FIG. 13 are respectively a partially enlarged view of the first rotation fulcrum 60 where the first boss portion 43*a* and the first engagement hole 53*a* engage with each other when the upper-surface cover 50 is disposed at the opening position and a partially enlarged view of the second rotation fulcrum 61 where the second boss portion 43*b* and the second engagement hole 53*b* engage with each other when the upper-surface cover 50 is disposed at the opening position.

When the upper-surface cover 50 is swung in an opening direction (upward direction) from the state in FIG. 3, as shown in FIG. 12, at the first rotation fulcrum 60, the support arm 51*a* contacts a lower end portion 41 as (swing limiting portion) of the arm inserting groove 41*a* when the upper-surface cover 50 swings a predetermined angle. In this way, a further swing of the upper-surface cover 50 is limited and the upper-surface cover 50 is kept at the opening position.

On the other hand, when the support arm 51*a* contacts the lower end portion 41 as of the arm inserting groove 41*a*, as shown in FIG. 13, at the second rotation fulcrum 61, a gap C is formed between the support arm 51*b* and a lower end portion 41*ba* of the arm inserting groove 41*b*. In other words, the swing of the upper-surface cover 50 is limited by only the contact between the support arm 51*a* and the lower end portion 41 as of the arm inserting groove 41*a*.

Figure 14:
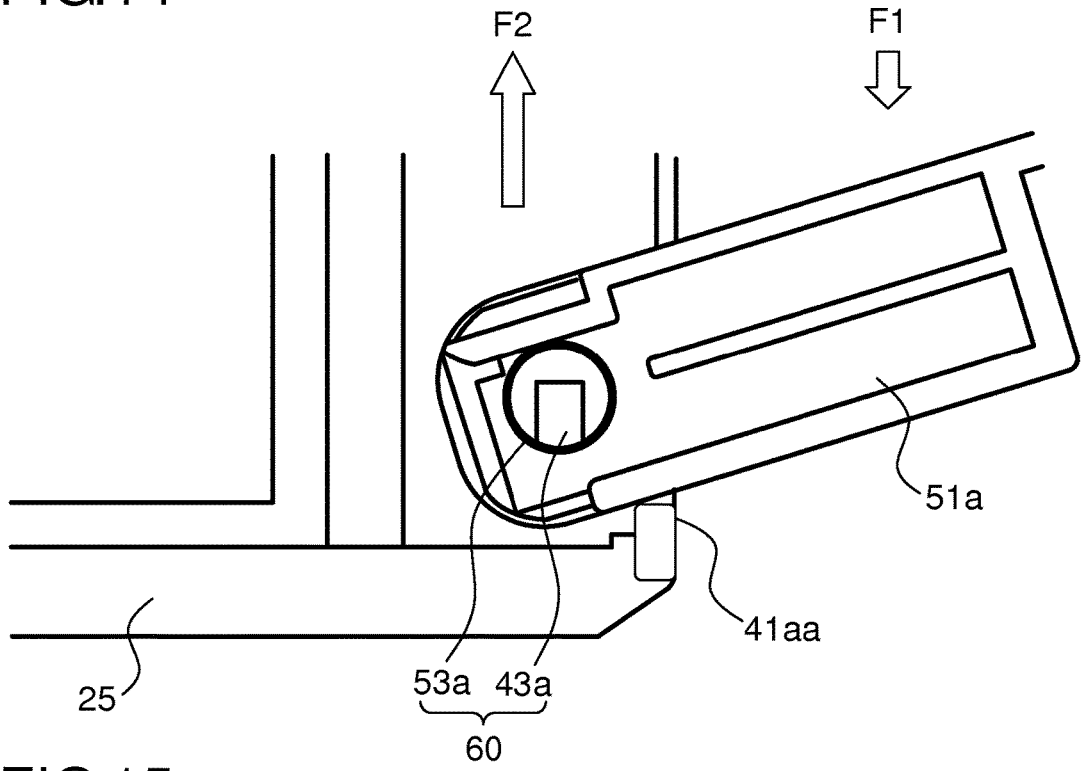
FIG. 14 is a side cross-sectional view of the first rotation fulcrum 60 when the upper-surface cover 50 is disposed at the opening position.
Figure 15:
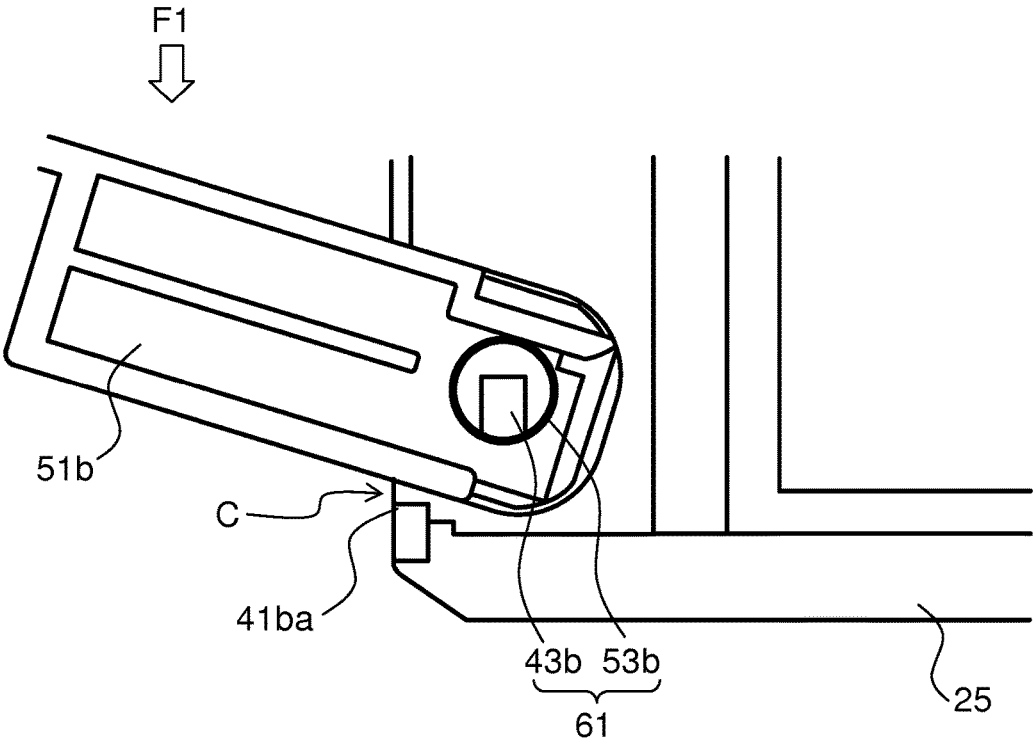
FIG. 15 is a side cross-sectional view of the second rotation fulcrum 61 when the upper-surface cover 50 is disposed at the opening position.

FIG. 14 and FIG. 15 are respectively a side cross-sectional view of the first rotation fulcrum 60 and second rotation fulcrum 61 when the upper-surface cover 50 is disposed at the opening position. When the upper-surface cover 50 is located at the opening position, if an opening-directional force F1 is further exerted on the upper-surface cover 50, as shown in FIG. 14, the contact portion of the support arm 51*a* and the lower end portion 41 as of the arm inserting groove 41*a* serves as a fulcrum of a lever, and an upward force F2 acts on the first rotation fulcrum 60. Here, a distance between the first rotation fulcrum 60 (action point) and the lower end portion 41*aa* (fulcrum) is shorter than a distance between the position (force applied point) where the force F1 is exerted and the lower end portion 41 as (fulcrum); accordingly, the force F2 acting on the first rotation fulcrum 60 becomes larger than the force F1.

However, as described above, the first boss portion 43*a* is larger than the second boss portion 43*b* in the protrusion amount; accordingly, an engagement tolerance (distance from the engagement position of the first boss portion 43*a* and first engagement hole 53*a* to the tip end portion of the first boss portion 43*a;* hereinafter, the same applies) between the first boss portion 43*a* and the first engagement hole 53*a* is larger than an engagement tolerance between the second boss portion 43*b* and the second engagement hole 53*b*. Because of this, even if the force F2 acts on the first rotation fulcrum 60, there is no risk that the first boss portion 43*a* and the first engagement hole 53*a* would disengage themselves from each other.

Besides, as shown in FIG. 15, when the upper-surface cover 50 is located at the opening position, the gap C is formed between the support arm 51*b* and the lower end portion 41*ba* of the arm inserting groove 41*b*, and the support arm 51*b* and the lower end portion 41*ba* do not contact each other. Because of this, even if the opening-directional force F1 is exerted on the upper-surface cover 50, the upward force F2 does not act on the second rotation fulcrum 61. Accordingly, there is no risk that the engagement of the second boss portion 43*b* and second engagement hole 53*b*, whose engagement tolerance is smaller than the engagement of the first boss portion 43*a* and first engagement hole 53*a*, would be disengaged.

According to the structure of the present embodiment, at the first rotation fulcrum 60 where the first boss portion 43*a* and the first engagement hole 53*a*, whose engagement tolerance is large, engage with each other, the swing of the upper-surface cover 50 is limited and the force attempting to swing the upper-surface cover 50 does not act on the second rotation fulcrum 61 where the second boss portion 43*b* and the second engagement hole 53*b*, whose engagement tolerance is small, engage with each other. Because of this, it is possible to prevent the opening and closing operation of the upper-surface cover 50 from causing the upper-surface cover 50 to leave the cassette base 25.

Besides, during an assembly time of the sheet feeding cassette 10, after the first boss portion 43*a* and the first engagement hole 53*a* are engaged with each other, by bending the support arm 51*b* and press-fitting the second boss portion 43*b*, whose protrusion amount is smaller than the first boss portion 43*a*, and the second engagement portion 53*b* into each other, it is possible to easily mount the upper-surface cover 50 onto the cassette base 25.

Besides, the present disclosure is not limited to the above embodiment, but various modifications are possible without departing from the spirit of the present disclosure. For example, in the above embodiment, the structure is employed, in which the first boss portion 43*a* and the second boss portion 43*b* protrude inward from the outside surfaces of the arm inserting grooves 41*a*, 41*b*. However, a structure may be employed, in which the first boss portion 43*a* and the second boss portion 43*b* protrude outward from the inner surfaces of the arm inserting grooves 41*a*, 41*b*. In this case, by making the distance between the support arms 51*a*, 51*b* smaller than the distance between the first boss portion 43*a* and the second boss portion 43*b*, it is possible to first engage the first boss portion 43*a* and the first engagement hole 53*a* of the support arm 51*a* with each other, thereafter, engage the second boss portion 43*b* and the second engagement hole 53*b* of the support arm 51*b* with each other by bending the support arm 51*b* outward.

Besides, a structure may be employed, in which the first boss portion 43*a* and the second boss portion 43*b* protrude from the support arms 51*a*, 51*b* of the upper-surface cover 50 and the wall surfaces of the arm inserting grooves 41*a*, 41*b* are provided with the first engagement hole 53*a* and the second engagement hole 53*b*. Or, a structure may be employed, in which the first rotation fulcrum 60 is composed of the first engagement hole 53*a* formed in the support arm 51*a* and the first boss portion 43*a* protruding from the arm inserting groove 41*a*, and the second rotation fulcrum 61 is composed of the second boss portion 43*b* protruding from the support arm 51*b* and the second engagement hole 53*b* formed in the wall of the arm inserting groove 41*b*.

Besides, in the above embodiment, the image forming apparatus 100 is described, in which the sheet feeding cassette 10 is mounted in an insertable or drawable manner in parallel with the sheet feeding direction. However, the present disclosure is also applicable, in quite the same way, to an image forming apparatus of so-called front loading type in which a sheet feeding cassette drawable in a direction perpendicular to a sheet feeding direction is mounted in a main body of the image forming apparatus.

Besides, the present disclosure is not limited to the monochromatic printer shown in FIG. 1, but, of course, is also applicable to image forming apparatuses of other types such as a color printer, a monochromatic copy machine, a color copy machine, a digital multi-function machine, a facsimile and the like.

The present disclosure is usable for a sheet storage cassette that stores sheet-like recording mediums. By using the present disclosure, it is possible to provide a sheet storage cassette with a simple structure in which even if an excessive force is exerted on an upper-surface cover in an opening direction, the upper-surface cover does not come off.

What is claimed is:

1. A sheet storage cassette comprising:

a cassette base that stores a sheet; and a cover member that is supported swingably on the cassette base and selectively disposed at a closing position to cover an upper surface of the cassette base and an opening position to open the upper surface of the cassette base, wherein the cover member is supported swingably at both ends of a side surface portion of the cassette base on a first rotation fulcrum, which is composed of a first engagement hole formed in the cover member and a first boss portion that is formed on the cassette base and engages with the first engagement hole, and on a second rotation fulcrum, which is composed of a second engagement hole formed in the cover member and a second boss portion that is formed on the cassette base and engages with the second engagement hole;

the cover member includes a pair of flexible support arms that are disposed at the rotation fulcrums of the cover to protrude, the first engagement hole is formed in one of the flexible support arms, the second engagement hole is formed in another of the flexible support arms, a pair of arm inserting grooves, into which the respective support arms are inserted, are formed at both ends of the side surface portion of the cassette base, the first boss portion and the second boss portion protrude inward from outside surfaces of the respective arm inserting grooves, and predetermined gaps, into which the support arms are insertable, are each formed between respective tip end portions of the first and second boss portions and each of inner wall surfaces of the arm inserting grooves;

a protruding amount of the first boss portion from the outside surface of the arm inserting groove is larger than a protruding amount of the second boss portion from the outside surface of the arm inserting groove; and a swing limiting portion, which limits an open angle of the cover member at the opening position, is disposed on only a portion of the cassette base near the first rotation fulcrum.

2. The sheet storage cassette according to claim 1, wherein a lower end portion of the arm inserting groove at the first rotation fulcrum is configured to be at a position higher than a lower end portion of the arm inserting groove at the second rotation fulcrum, when the cover member is disposed at the opening position, the lower end portion of the arm inserting groove at the first rotation fulcrum contacts the support arm to serve as the swing limiting portion, and a gap is formed between the support arm at the second rotation fulcrum and the lower end portion of the arm inserting groove.

3. The sheet storage cassette according to claim 2, wherein a distance between the pair of support arms is wider than a distance between the first boss portion and the second boss portion.

4. An image forming apparatus comprising the sheet storage cassette according to clam 1.

* * * * *